United States Patent [19]

Takahashi

[11] Patent Number: 5,048,704

[45] Date of Patent: Sep. 17, 1991

[54] DETACHABLE INTERCONNECTING ARRANGEMENT

[75] Inventor: Tokuo Takahashi, Tokyo, Japan

[73] Assignee: Kawada Co., Ltd., Tokyo, Japan

[21] Appl. No.: 260,464

[22] Filed: Oct. 20, 1988

[30] Foreign Application Priority Data

Oct. 21, 1987 [JP] Japan ..... 62-159960[U]

[51] Int. Cl.[5] ..... A63H 19/18

[52] U.S. Cl. ..... 213/75 D; 446/138

[58] Field of Search ..... 213/75 D, 75 TC, 75 R; 446/137, 138, 139

[56] References Cited

U.S. PATENT DOCUMENTS

| | | | |
|---|---|---|---|
| 2,500,180 | 3/1950 | Hubbell | 213/75 D |
| 2,607,157 | 8/1952 | Smith | 213/75 D |
| 2,939,245 | 6/1960 | Orel | 446/138 |
| 3,303,606 | 2/1967 | Mann | 446/138 |
| 3,330,066 | 7/1967 | Crawford | 213/75 D |
| 3,605,332 | 1/1970 | Stepek | 213/75 TC |

FOREIGN PATENT DOCUMENTS

| | | | |
|---|---|---|---|
| 2442633 | 3/1976 | Fed. Rep. of Germany | 213/75 TC |
| 2219684 | 8/1979 | Fed. Rep. of Germany | 213/75 D |
| 3339521 | 5/1985 | Fed. Rep. of Germany | 446/138 |
| 642829 | 9/1950 | United Kingdom | 446/138 |
| 1437426 | 5/1976 | United Kingdom | 213/75 TC |

*Primary Examiner*—Robert J. Oberleitner
*Assistant Examiner*—Mark T. Le

[57] ABSTRACT

A detachably coupling device for a detachably coupling two bodies. The detachable coupling device on each of the bodies comprises a magnet movably mounted on the body and having a north pole and a south pole. The strength of the magnetic field existing between the magnets on the first body the second body may be selected to allow, preferably, manual detachable coupling of the two bodies. As the two bodies are placed closer together until the magnets are contiguous, the movement of the magnets will cause the magnets under the influence of the magnetic field to move until the north pole of one magnet is contiguous the south pole of the other magnet thereby coupling the two bodies together.

7 Claims, 6 Drawing Sheets

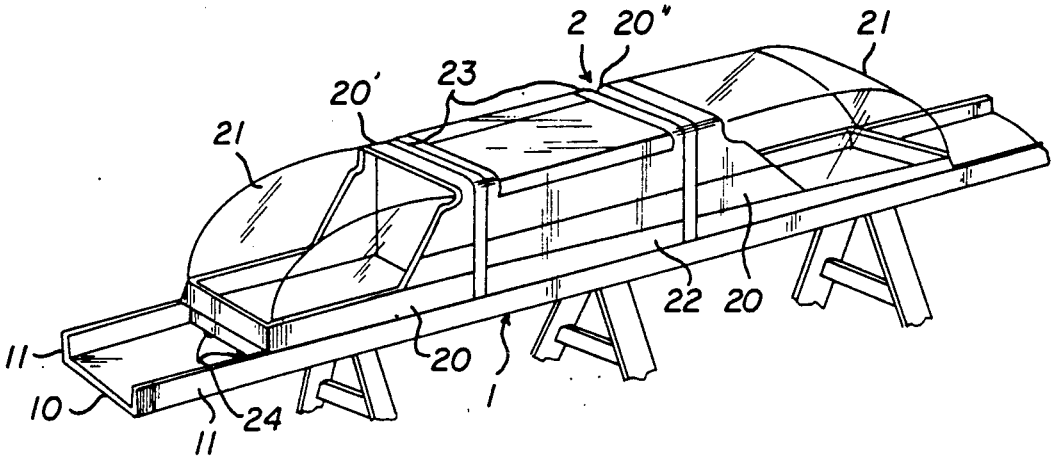
FIG. 1
FIG. 2
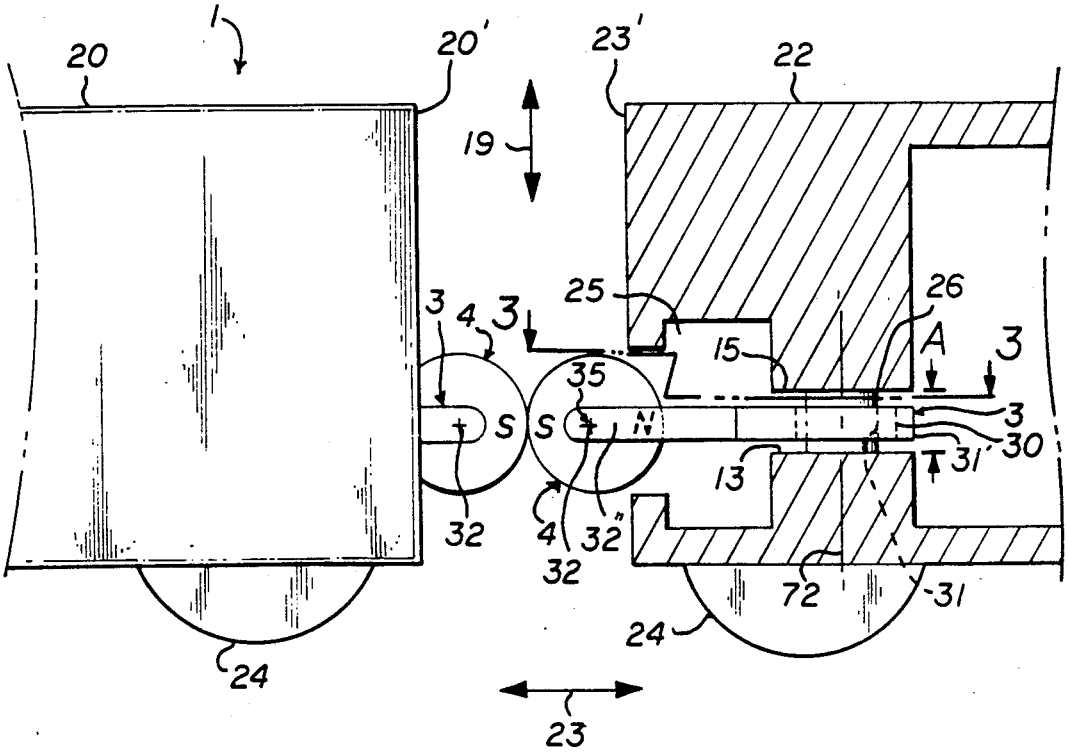

FIG. 3
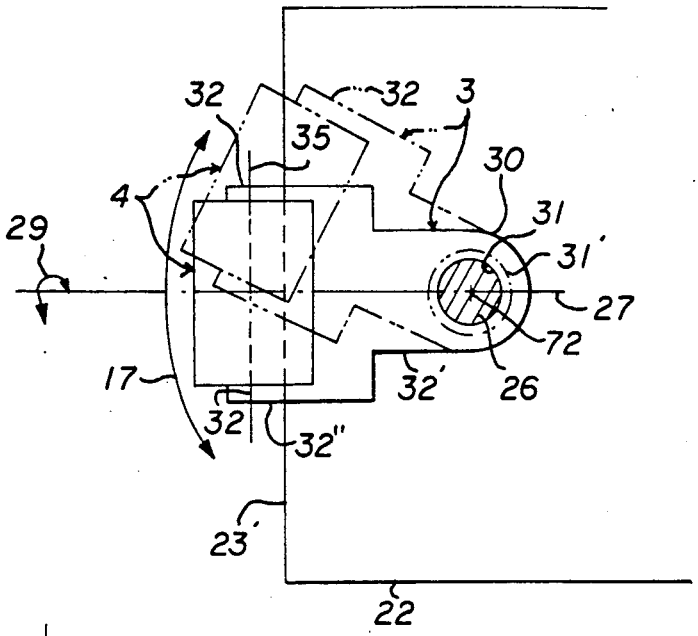
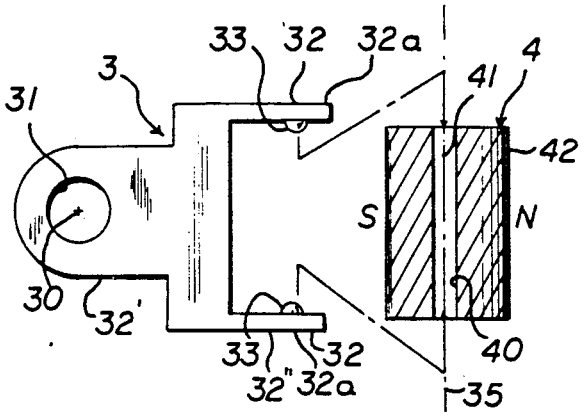
FIG. 4
FIG. 5
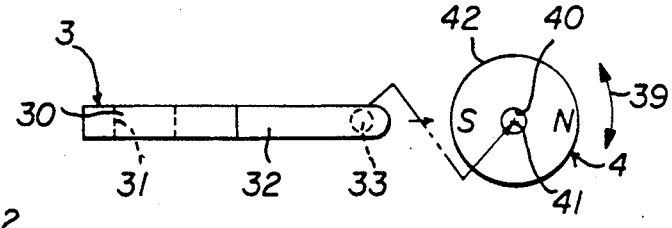
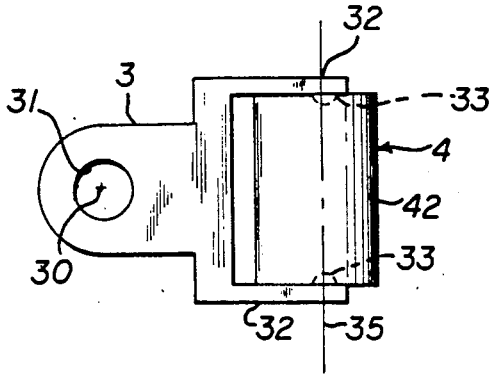
FIG. 6
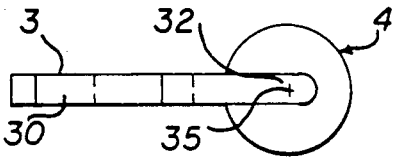
FIG. 7

DETACHABLE INTERCONNECTING ARRANGEMENT

BACKGROUND OF THE INVENTION

1. Field of the Invention

This invention relates to the coupling art and more particularly to an improved detachable coupling arrangement for coupling a first body means to a second body means by utilization of magnetic force.

2. Description Of The Prior Art

In many applications particularly those involving toys such as the coupling arrangements between toy cars of a train, trucks or the like, there have often been provided mechanical type couplings. Such mechanical type couplings have often incorporated a hook on one of the body means and a loop to the other body means. The two bodies were coupled together by linking the hook of one body means with the loop on the other body means. To allow for greater play value such hook and loop connections were also constructed to allow for manual detachment of the hook from the loop to provide for disconnecting the two body means.

However, in many applications it was found that some children, particularly little children, do not have the manual dexterity necessary to effectuate the desired mechanical connections associated with the coupling such as, for example, placing the hook in the loop of the abovementioned type of mechanical connection. Thus, many type of toys such as trains or other vehicles have a number of portions which are desired to be detachably coupleable together to allow for readily decoupling when desired could not be conveniently utilized by such children because of their dexterity limitations.

Further, the hook and loop type of connection as described above often resulted in unintentional decoupling when the relative positions of the first body to the second body were such that under the influence of gravity or other forces, the hook would unintentionally become disengaqed from the loop.

SUMMARY OF THE INVENTION

Accordingly, it is an object of the present invention to provide an improved coupling arrangement.

It is another object of the present invention to provide an improved detachable coupling arrangement.

It is yet another object of the present invention to provide a detachable coupling arrangement particularly useful in toy applications.

It is yet another object of the present invention to provide a detachable coupling arrangement for use in toy applications in which the detachable coupling is achieved by use of magnetic force.

The above and other objects of the present invention are achieved, according to a preferred embodiment of the present invention, by providing at least two body means which are to be detachably coupled together. Each of the body means has a coupling end. The detachable coupling means is movably mounted on the coupling end of at least one of the body means and, in other preferred embodiments of the present invention, detachable coupling means is movably mounted on each of the body means which are to be detachably coupled together. In the embodiments of the present invention wherein the detachable coupling means are the same on each body means, the detachable coupling means is movably mounted on each body means and generally comprises a coupling support means on the body means and a bracket means movably mounted on the coupling support means for at least limited movement in a predetermined number of directions. The coupling support means may be a post and the bracket means may have an inner portion having walls defining an aperture therethrough and the post is positioned within the aperture so that the bracket means may rotate about the axis of the post. The diameter of the post and the corresponding diameter of the aperture in the first portion of the bracket means may be selected so that only two directions of movement, that is, pivotal movement about the axis of the post by the bracket means is allowed, or, alternatively, the aperture in the inner portion of the bracket means may be larger than the diameter of the post to thereby allow rotational movement about an axis perpendicular to the post and lying within the plane of the rotational movement of the bracket means. Additionally, if desired, the axial extent of the aperture in the inner portion of the bracket means may be less than the axial extent of the post. In such an embodiment the bracket means may have reciprocal movement in axial directions along the post which provides opposite reciprocal movement towards and away from the directional extent of the plane of rotation of the bracket means about the post. Thus, 2, 4 or 6 directions of movement may be provided for the bracket means as described above.

A magnet means is rotatably mounted for rotational movement on the outer portion of the bracket means for rotation about a magnet axis. The magnet axis, in preferred embodiments of the present invention, lies in the plane of rotation of the bracket means about the post. The magnet means has a north pole and south pole and the north pole and the south pole are alternately positionable in an outwardly disposed orientation from the coupling end of the body means. The magnet means, for example, may be cylindrical having an outer surface and an axial aperture therethrough. Axle means are provided on the outer portion of the bracket means and extend into the axial aperture in the magnet means.

For those embodiments of the present invention wherein each of the coupling means on each body means is substantially the same and as described above, as the coupling end of one body means approaches the coupling end of another body, the magnet means on each body will rotate about its magnet axis until the opposite polarity of the magnets is achieved and the attractive force between the magnets will detachably couple the two bodies means together when the two magnet means are contiguous. The strength of the magnetic field between the two magnet means is selected, particularly in toy applications of the present invention, to allow for manual detachment of the body means from each other. That is, the strength of the magnetic field may be selected so that, for example, a child may pull the two bodies apart when desired.

It will be appreciated that with the greater the number of directions of movement allowed to each magnet means, the greater may be the deviation from alignment between the body means that are to be detachably coupled together. Further, the detachable coupling means in the means as above described will remained coupled even though the two body means are in different relative orientations such as those that occur when a toy train comprised of a plurality of cars detachably coupled to each other travels around a bend, goes over the crest of a hill or completes travel down one hill and starts up another hill. In each of these situations there will be different geometrical alignments of the body means during at least portions of such travel and both the rotation of the magnet means as well as the permitted movements of the bracket means which supports the magnet means allows for convenient detachable coupling of each of such cars at any location.

BRIEF DESCRIPTION OF THE DRAWING

The above and other embodiments of the present invention may be more fully understood from the following detail description taken together with the accompanying drawings wherein similar referenced characters refer to similar elements throughout and in which:

FIG. 1 illustrates a preferred embodiment of the present invention;

FIGS. 2 through 10 illustrate a detachable coupling means useful in the practice of the present invention;

DESCRIPTION OF THE PREFERRED EMBODIMENTS

Figure 8:
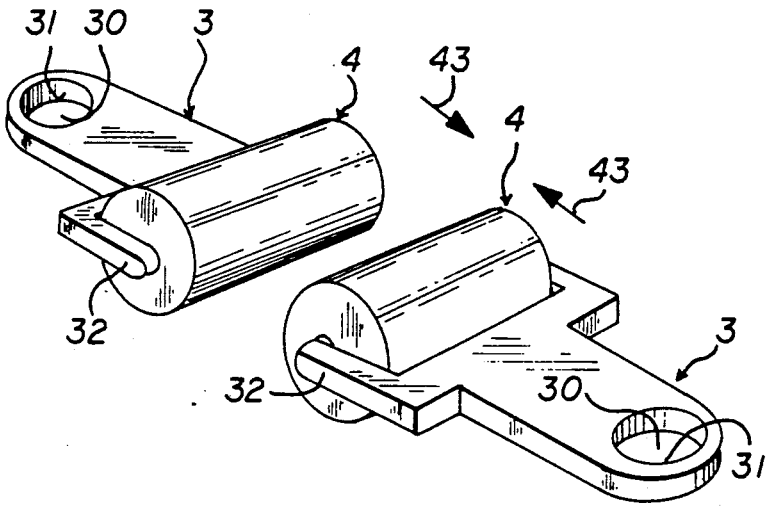

In the following description of the preferred embodiments of the present invention, the principles of the present invention are illustrated by application of a detachable coupling means in a toy train. However, it will be appreciated that the principles of the present may be utilized in a variety of applications and is not limited by the structural details associated with the toy train described herein.

Referring now to the drawing there is shown in FIG. 1 an embodiment 1 generally comprised of a toy train 2 adapted to move along a track generally designated 10 which, in the embodiment 1 has lateral upright members 11. The toy train 2 moves on wheels 24. In the embodiment 1 there may be provided 3 separate cars or body means which are to be detachably coupled together according to the principles of the present invention. In the embodiment 1, the first car and third car are designated 20 and may, for example, be fabricated substantially identical. Each of the first and third cars 20 may have a clear plastic covering 21 thereon to allow visual access to the interior thereof. Such clear plastic cover 21 may, for example, be removable so that different figurines (not shown) may be positioned therein to enhance the play value of the present invention. The first car 20 has a coupling end 20' and the third car has a coupling end 20''. The middle car 22 which, for example, may contain a power unit for moving the toy train 22 along the trac means 10 has a coupling end 23 at each end thereof. According to the principles of the present invention each of the cars 20 are detachably coupled to the middle car 22. It will be appreciated, of course, that as many additional cars may be positioned intermediate any of the three cars described above and be of any configuration desired to represent any type of train other type of vehicle.

Referring now to FIGS. 2 and 3 there is illustrated the detachable coupling arrangement according to the principles of the present invention for detachably coupling the first car 20 at its coupling end 20' to the second car 22 at its forward coupling end 23'. In the embodiment 1 as illustrated in FIGS. 1 through 10 the detachable coupling arrangement of the present invention is substantially identical on each of the cars 20 and 22. It will be appreciated, of course, that different structural arrangements may be utilized for the detachable coupling means on different of the cars or body means which are to be detachably coupled together as long as they are operationally competable with each other. As can be seen, the coupling end 23' of the car 22 is positionable adjacent the coupling end 20' of the car 20 for detachable coupling therebetween. A detachable coupling means generally designated 3 is movably mounted on each of the cars or body means 20 and 22. Each of the detachably coupling means 3 comprises a coupling support means 26 on the car or body means 22 in regions adjacent the coupling end of the body means. The coupling support means 26 in the embodiment 1 comprises a generally cylindrical post having a predetermined diameter and a predetermined axis 72. The coupling support 26 also has a predetermined axial extent indicated in FIG. 2 by the letter A. As shown in FIG. 2, axial length A of the post 26 is determined by the distance separating the bounding surfaces 13 and 15. The separation between the bounding surfaces 13 and 15 of the car 22 may be selected for particular applications as desired and the dimension A, therefore, may be increased or decreased as desired.

The detachable coupling means 3 has a bracket means 32 movably mounted on the post 26 for pivotal movement in a direction indicated by the arrow 17 in FIG. 3. The bracket means 32 has an inner portion 32' and an outer portion 32''. The inner portion 32' of a bracket means 32 has walls 31 defining an axial aperture therethrough. The walls 31 may provide a comparatively snug fit about the post 26 so that the movement of the bracket means 32 is limited to the two directions indicated by the arrow 17. Alternatively, the aperture in the inner portion 32' of the bracket means 32 may be larger than the diameter of the post means 26 as indicated in the phantom lines 31'. Depending upon the amount of clearance between the post 26 and the walls 31' in the bracket means 32 there will be varying amounts of movement in various directions of the bracket means 32 with respect to the car or body means 22. Thus, the spacing of the bounding walls 13 and 15 define how much reciprocal movement in the two directions indicated by the arrow 19 in FIG. 2 will be allowed. Additionally, depending upon the clearance between the post 26 and walls 31', there will be varying amounts of movement in the directions indicated by the arrow 23 in two directions essentially perpendicular to the direction of movement indicated by the arrow 19 as well as rotational movement of the bracket means 32 about an axis generally indicated by the arrow 27 in FIG. 3 lying in the plane of the bracket means 32 and perpendicular to the axis 72 of the post 26. The amount of such rotational motion as indicated by the double ended arrow 29 in FIG. 3 about the axis 27 will also be limited by the relative spacing between the bounding walls 13 and 15, the axial thickness of inner portion 33', and the clearance between post 26 and the walls 31'.

In FIG. 3 the position of the coupling means 3 in an aligned fore and aft position is shown in solid lines and the pivotal movement in one of the directions indicated by the arrow 17 as shown in phantom lines in FIG. 3. The amount of such pivotal motion in both of the directions indicated by the arrow 17 may be as great or as little as desired for particular applications.

The detachable coupling means 3 also comprises a magnet 4 rotatably mounted for rotational movement on the outer portion 32'' of the bracket means 32 about a magnet axis as indicated at 35. Referring now to FIGS. 4 through 7 the structural details of the bracket means 32 and magnet 4 are shown in an exploded view in FIGS. 4 and 5 and an assembled view in FIGS. 6 and 7. As shown thereon the magnet means 4 has an outer surface generally designated 42 and walls 40 defining an axial aperture 41 therethrough. The bracket means 32 has a pair of spaced apart arms 32*a* on the forward portion 32'' and a pair of projections 33 thereon. The magnet 4 is rotatably mounted on the projections 33 by the insertion of the projections 33 into the aperture 41 for rotary movement in the directions indicated by the arrow 39 in FIG. 5.

The magnet means 4 has both a north pole and a south pole and, of course, these will be oppositely disposed about the magnet axis 35. Thus, the north pole and the south pole of the magnet means 4 at the exterior surface 42 thereof, is alternately positionable in an outwardly disposed orientation from the coupling end of the body means upon which it is mounted.

Figure 9:
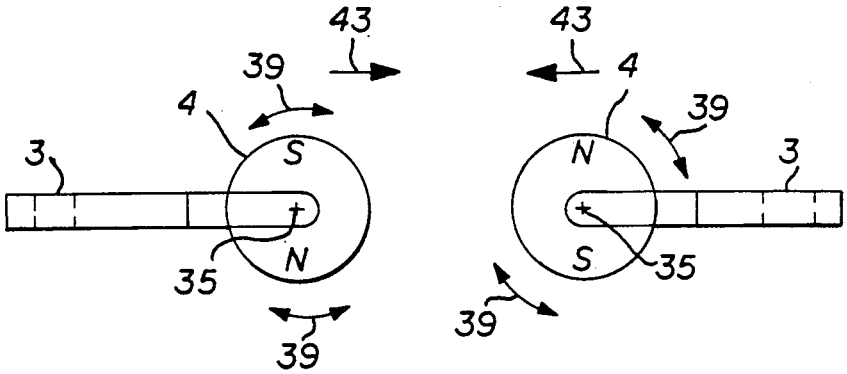
Figure 10:
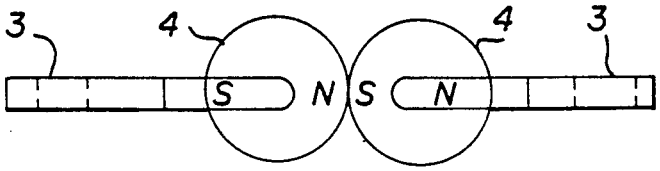

FIGS. 8, 9 and 10 illustrate the operation of two such coupling means 3. As shown in FIGS. 8, 9 and 10 as the detachable coupling means 3 are moved towards each other as indicated by the arrows 43 the magnets 4 will automatically rotate about the magnet means axis 35 in directions indicated by the arrows 39 until the north pole of one of the magnet means 4 is contiguous to the south pole of the other magnet means 4. At such a point the preselected magnetic force as determined by the magnetic field strength existing between the two magnet means 4 holds the two magnet means 4 together and, consequently, detachably couples the car means 20 and 22 to each other. (The car means have been omitted from FIGS. 4 through 10 for clarity).

It will be appreciated that relative misalignments of the car means 22 with respect to the car means 20 as may occur in a toy train or in other toy vehicle type of applications of the present invention, the multiplicity of directions of movement of the bracket means 32 with respect to the body means provides a high degree of utility to the present invention since precise alignment of parts is not necessary, as was often the case with mechanical attachments. The coupling is accomplished without requiring any high degree of manual dexterity since merely moving the two body means having the detachable coupling of the present invention thereon towards each other will automatically provide the desired detachable coupling. It will be appreciated that the strength of the magnetic field between the two magnet means 4 may be selected to provide any degree of coupling therebetween. In preferred embodiments of the present invention the strength of the field is selected to become compatible with the persons who will utilize the device incorporating the present invention. For comparatively small children in which the principles of the present invention are embodied in a toy such as in embodiment 1 described herein, the magnetic field strength may be comparatively low so that even small children may be able to have extended play value with such a toy. On the other hand, in other applications it may be desired to have a comparatively strong magnetic field existing between the two magnets and the strength of the field may be selected to achieve any desired degree of coupling.

Other structural arrangements for providing the detachable coupling of the present invention may also be utilized. FIGS. 11 through 19 show another embodiment generally designated 100 of a detachable coupling mechanism according to the present invention.

Figure 11:
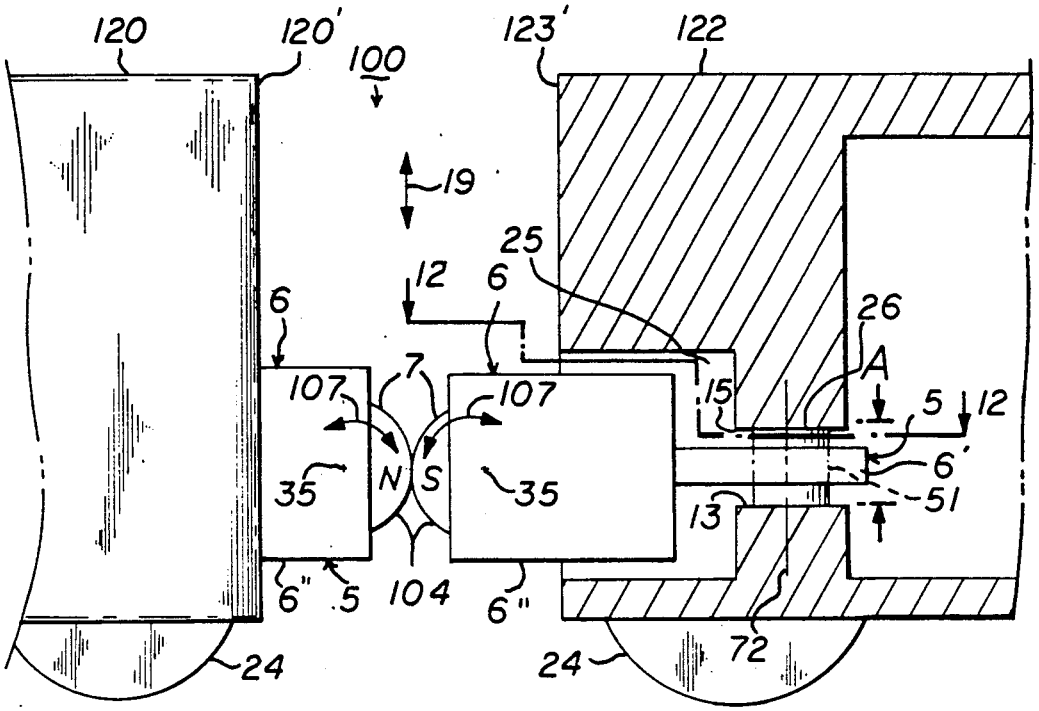
FIGS. 11 through 19 illustrate another embodiment of a coupling means useful in the praotioe of the present invention.

FIG. 11 is generally similar to FIG. 2 and illustrates two body means generally designated 120 and 122 which, for example, may be similar to the body means or cars 20 and 22, respectively, of the embodiment of FIG. 1 described above. Thus, the body means 120 has a coupling end 120' and the body means 122 has a forward coupling end 123'. In the embodiment 100 both the body means 120 and the body means 122 are provided with substantially identical detachable coupling means 5. It will be appreciated, however, that the detachable coupling means 3 of embodiment 1 could equally well be utilized in place of one of the detachable coupling means 5 in the embodiment 100.

The detachable coupling means 5 is movably mounted on the body means 122 and generally comprises a first coupling support means 26 which may be identical to the coupling support means 26 of embodiment 1 described above on said body means 122. The coupling support means 26 generally comprises a post having an axial extent as indicated by A on FIG. 11 provided by the separation between bounding surfaces 13 and 15 of the body means 122.

Figure 12:
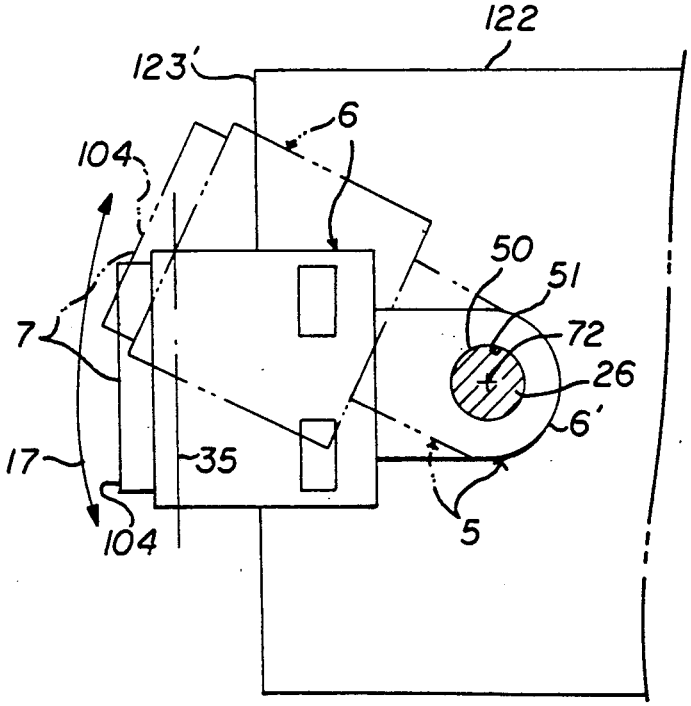
Figure 13:
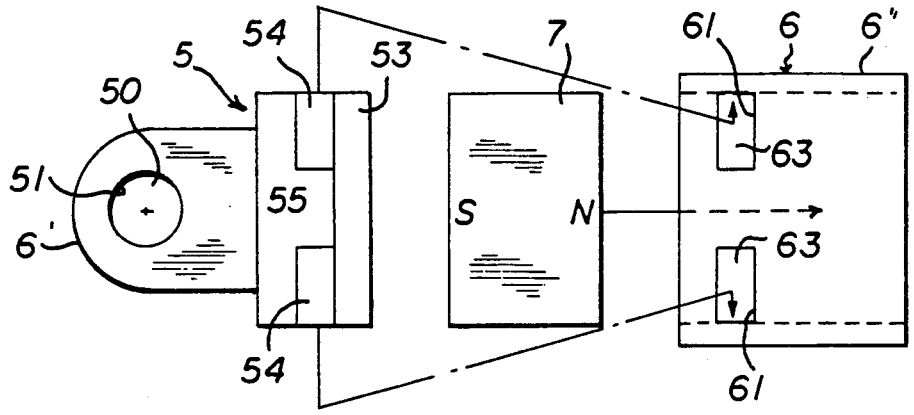
Figure 14:
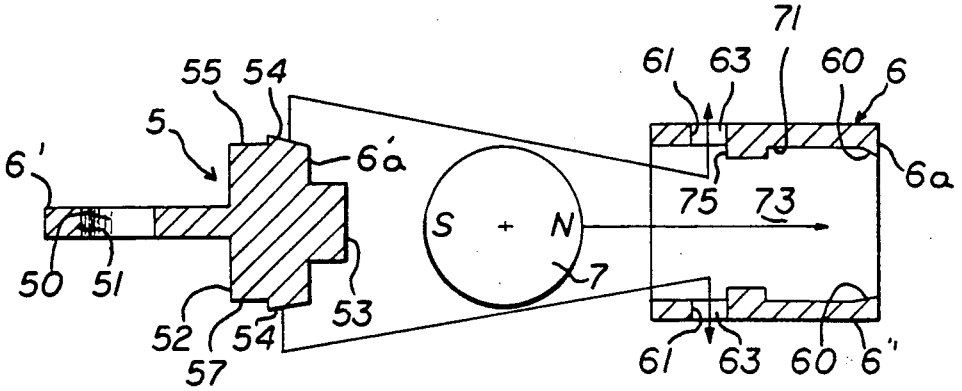
Figure 15:
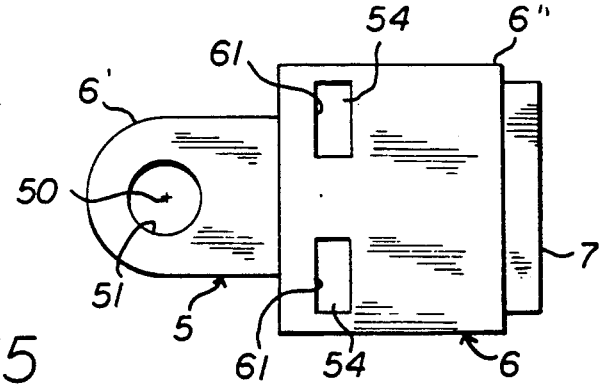

The detachable coupling means 5 comprises a bracket means 6 having an inner portion 6' and an outer portion 6''. The inner portion 6' has walls 51 defining an aperture 50 therethrough and the coupling support means 26 is positioned in the aperture 50. The bracket means 6 is pivotally mounted on the bracket support means 26 for limited pivotal motion in the directions indicated by the arrow 17 as shown on FIG. 12. It will be appreciated that the limited pivotal motion of bracket means 6 in the two directions indicated by the arrow 17 is substantially the same as the limited pivotal motion of the bracket 32 in the directions of the arrow 17 in embodiment 1 described above. In FIG. 12 the extent of the limited pivotal motion of the bracket means 5 in one of the two directions as indicated by the double ended arrow 17 is shown in phantom lines and, it will be appreciated, the bracket means 5 may also pivot in the other direction indicated by the double ended arrow 17 from the position shown in solid lines in FIG. 12. Thus, full pivotal movement of the bracket means 5 may be similar to the pivotal movement of the bracket 32 of embodiment 1 described above.

In the embodiment 100 the aperture 50 defined by walls 51 in the inner portion 6' of the bracket 6 provides a comparatively snug fit on the coupling support means 26. It will be appreciated, however, that a larger aperture 50 may be provided by having a greater diameter of the aperture 50 defined by the walls 51 such as illustrated in FIG. 3 by the walls 31'.

The bracket means 6 thus has the pivotal motion indicated by the arrow 17 and the reciprocal motion in the two directions indicated by the double ended arrow 19. The extent of the reciprocal motion in the direction of the double ended arrow 19 is limited by the bounding walls 13 and 15.

A magnet 7 is mounted on the bracket means 6 for rotation in a direction indicated by the arrow 107 about a magnet axis 35. The magnet 7 has an outer surface 104 and, as illustrated in FIG. 11 when the two coupling means 6 are contiguous each other the north pole of one of the magnet 7 will be magnetically coupled to the south pole of the other magnet 7 by the magnetic field generated therebetween. The strength of the magnetic field may be selected as desired for particular applications as described above in connection with the magnets 4 of embodiment 1.

FIGS. 13 through 16 illustrate the structural details of the detachable coupling means 5. As shown, the inner portion 6' is a separate structure from the outer portion 6'' of the bracket means 6. Thus, the inner portion 6' has tabs 54 on the upper surface 55 thereof and lower surface 57 thereof. The inner portion 6' also has a magnet abutment surface 53 for abutment against the magnet 7.

Figure 16:
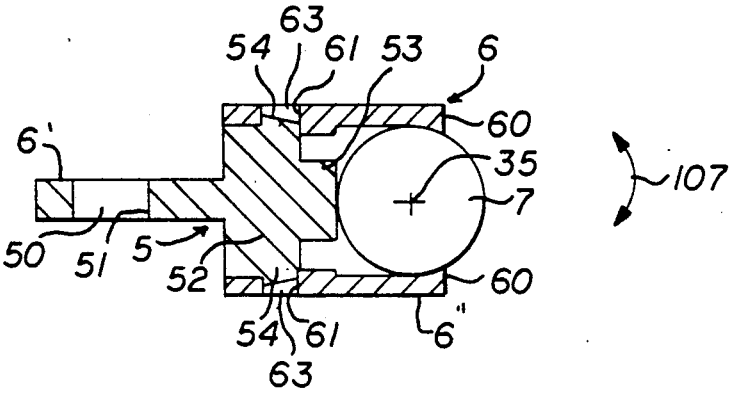

The outer portion 6'' of the bracket means 6 has internal walls 61 defining tab receiving apertures 63 into which the tabs 54 of the inner portion 6' of the bracket means 6 may be positioned as shown most clearly in FIG. 16. The forward portion 6'' also has cavity defining walls 71 defining a magnet receiving cavity 73 therein. The magnet receiving cavity 71 has a shoulder portion 75 and a restricted portion 60 at the outermost end **6*a* of the bracket means 6**.

The magnet 7 is inserted into the cavity 73 and abuts against the restricted portion defined by the walls 60 in rotatable relationship thereto. The inner portion 6' of the bracket means 6 is inserted into the cavity 73 of the outer portion 6'' and the wall 53 abuts against the magnet 7. A shoulder **6'*a* abuts against the shoulder 75 so that the wall 53 lightly engages the magnet 7 with a force sufficient to restrain the magnet 7 in the position shown in FIG. 16 but still allow the magnet 7 to rotate about the magnet axis 35 in the direction indicated by the double ended arrow 107. The portion 52 of the inner portion 6' of the bracket means 6 is, therefore, retained within the outer portion 6'' of the bracket means 6 by the engagement of the tabs 54 in the aperture 63 and the abutment of the shoulder 6'*a* with the shoulder 75. Therefore there is no movement of the inner portion 6' with respect to the magnet 7 such as might cause the magnet 7** to bind.

Figure 17:
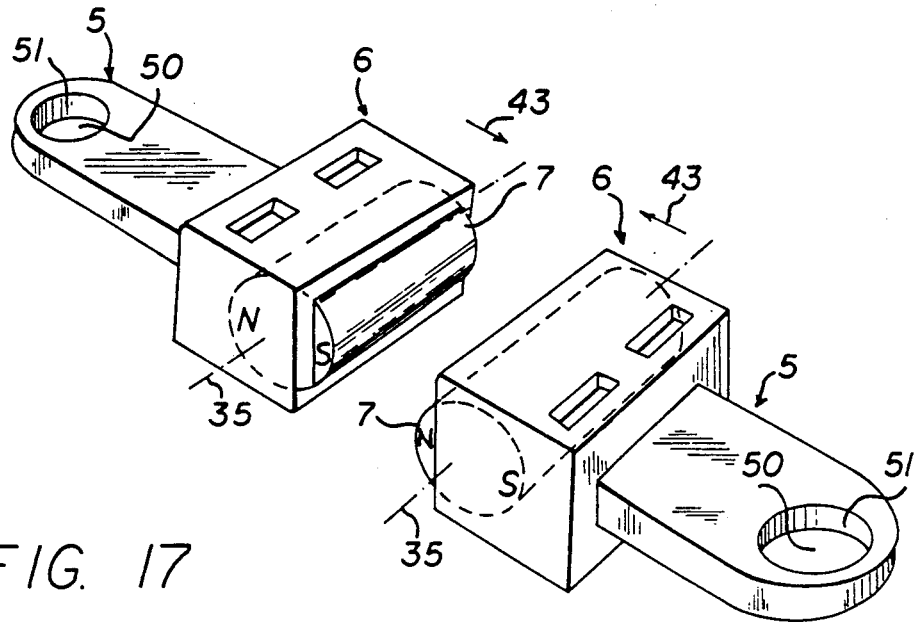
Figure 18:
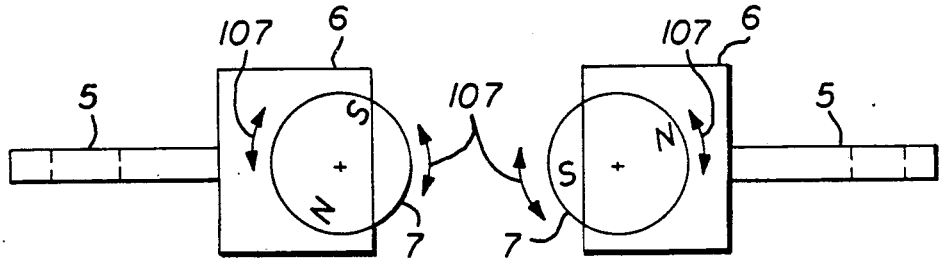
Figure 19:
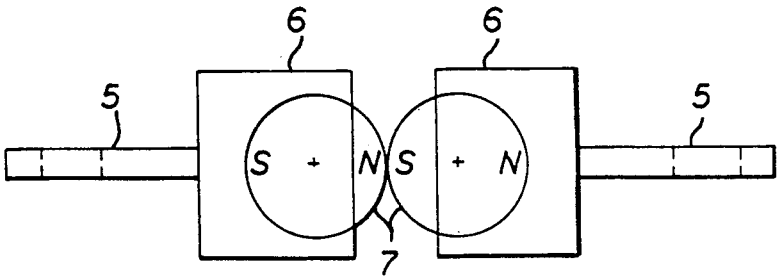

FIGS. 17, 18 and 19 are generally similar to FIGS. 8, 9 and 10 and illustrate the action of the detachable coupling means 5 as two such coupling means approach each other in the directions indicated by the arrows 43. As can be seen, as the detachable coupling means 5 move toward each other, the magnets will rotate until there is opposite polarity of the magnet 7. That is, one magnet 7 will have its north pole contiguous to the south pole of the other magnet 7.

It will appreciated that in other embodiments of the present invention the shape of the magnet may be changed from the cylindrical form as shown for the magnet 7 in embodiment 100 and tubular form as shown for the magnet 4 in the embodiment 1 to any other desired configuration such as polyhedral, spherical or any other shape provided that such magnets may be supported by the bracket means for a pivotal motion as described herein and such that the magnetic strength generated by the two magnets is sufficient to accomplish the purpose.

As is clear from the above explanation, the detachable coupling mechanism of the present invention provides magnets whose poles will alternately be positioned contiguous to another magnet as such magnets rotate about their axes to provide the attractive magnetic force between two such magnets. Thus the two magnets are held together and the body means upon which the two magnets are mounted are also coupled together. Separation of the two coupled bodies can be achieved by pulling the two magnets apart with a force greater than that of the magnetic field strength generated by the two magnets. For this reason, coupling and separation of the objects to which the detachable coupling means are attached is comparatively much easier than with the prior art toy mechanical couplings and requires considerably less mechanical dexterity and skill on the behalf of the user. Further, because of the magnetic coupling between two of the magnets of the detachable coupling means according to the principle of the present invention and the mounting thereof with multiple directions of movement available, it will be appreciated that embodiments of the present invention may provide more secure coupling between two-body means in different geometrical relationships to each other and as heretofore been achievable with the mechanical type couplings of the prior art. Further, it will appreciated that by merely moving the detachable coupling means on one body means towards another detachable coupling means on a second body means, as the approach gets closer the attractive therebetween becomes greater and thus even the magnets themselves assist in providing the coupling before such magnets are contiguous.

This concludes the description of the preferred embodiments of the present invention. It will be appreciated that the accompanying drawings are intended to cover all variations and adaptations of the present invention falling within the true scope and spirit thereof.

What is claimed is:

1. A detachable interconnection arrangement comprising, in combination:

a first body means;

a second body means for detachable coupling to said first body means, and each of said first body means and said second body means having at least one coupling end for positioning adjacent a coupling end of the other body means;

first movable detachable coupling means movably mounted on said first body means at said coupling end thereof, and said first detachable coupling means comprising:

first coupling support means on said first body means;

bracket means movably mounted on said first coupling support means for at least limited movement in a first predetermined number of directions, and having an outer portion at said coupling end of said body means;

first cylindrical magnet means rotatably mounted for rotational movement on said bracket means at said outer portion thereof for rotation about a first magnet axis, and said first magnet means having a north pole and south pole alternatively positionable outwardly disposed from said coupling end of said first body means;

second movable detachable coupling means movably mounted on said second body means at said coupling end thereof, and said second detachable coupling means comprising:

second coupling support means on said second body means;

second bracket means movably mounted on said second coupling support means for at least limited movement in a second predetermined number of directions, and having an outer portion at said coupling end of said second body means;

second cylindrical magnet means rotatably mounted for rotational movement on said second bracket means at said outer portion thereof for rotation about a second magnet axis, said second cylindrical magnet means having a north pole and south pole alternatively positionable outwardly disposed from said coupling end of said second body means;

said second cylindrical magnet means positionable contiguous said first magnet means and defining a magnetic field therebetween having a predetermined strength for detachable tangential coupling of said first magnet means to said second magnet means to thereby detachably couple said first body means to said second body means;

said first and said second coupling support means each comprising a post means having a first preselected diameter and a preselected axis;

said first and said second bracket means each have:

an inner portion spaced from said outer portion thereof, and each of said inner portions having:

walls defining an aperture having a second preselected diameter larger than said first preselected diameter of said post means;

said first coupling support means positioned in said aperture in said first bracket means, and said second coupling support means positioned in said aperture in said second bracket means;

an axle means on said outer portion of each of said first and said second bracket means; and each of said first and said second cylindrical magnet means is tubular and mounted on said axle means of said first bracket means and said second bracket means, respectively, and each of said first and second cylindrical magnet means further comprising surface walls defining an outer surface and interior walls defining an axial aperture, and said axle means of said first bracket means positioned in said axial aperture of said first magnet means and said axle means of said second bracket means positioned in said axial aperture of said second magnet means.

2. The arrangement defined in claim 1 wherein:

said moveable mounting of said first bracket means on said first coupling support means is limited pivotal movement in a first plane; and said first predetermined number of directions is two opposed directions in said first plane.

3. The arrangement defined in claim 1 wherein:

said moveable mounting of said first bracket means on said first coupling support means is limited pivotal movement in a first plane and limited reciprocal movement towards and away from said first plane;

said first predetermined number of directions is four comprising two opposed directions of said limited pivotal movement in said first plane and two opposed reciprocal directions towards and away from said first plane.

4. The arrangement defined in claim 1 wherein:

said moveable mounting of said first bracket means on said first coupling support means is limited pivotal movement in a first plane, limited reciprocal movement towards and away from said first plane, and limited pivoting movement about any axis substantially perpendicular to said reciprocal directions; and said first predetermined number of directions is six comprising said two opposed directions of pivotal movement in said first plane, said two opposed reciprocal directions towards and away from said first plane and said two opposed directions of limited pivoting movement about said axis.

5. The arrangement defined in claims 2, 3 or 4 wherein:

said first magnet axis is positionable in said first plane.

6. The arrangement defined in claim 1 wherein:

said first magnetic axis and said second magnetic axis are positionable parallel to each other.

7. The arrangement defined in claim 1 wherein:

said preselected strength of said magnetic field defined between said first magnet means and said magnet means is selected to allow manual detaching said first body means from said second body means.

* * * * *